US006368169B1

(12) United States Patent
Jaeger

(10) Patent No.: US 6,368,169 B1
(45) Date of Patent: Apr. 9, 2002

(54) MARINE ENGINE COOLING SYSTEM WITH SIPHON INHIBITING DEVICE

(75) Inventor: Matthew W. Jaeger, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/717,773

(22) Filed: Nov. 21, 2000

(51) Int. Cl.[7] ..... B63H 21/10
(52) U.S. Cl. ..... 440/88; 123/41.44
(58) Field of Search ..... 440/88; 123/41.13, 123/41.44

(56) References Cited

U.S. PATENT DOCUMENTS 3,550,612 A * 12/1970 Maxon ..... 123/41.44
4,669,988 A * 6/1987 Breckenfeld et al. .... 123/41.13
5,334,063 A 8/1994 Inoue et al. ..... 440/88
5,980,342 A 11/1999 Logan et al. ..... 440/88
6,004,175 A 12/1999 McCoy ..... 440/88
6,135,064 A 10/2000 Logan et al. ..... 123/41

* cited by examiner

*Primary Examiner*—Jesus D. Sotelo
(74) *Attorney, Agent, or Firm*—William D. Lanyi

(57) ABSTRACT

A siphon inhibiting valve is provided for a marine engine cooling system. The purpose of the valve is to prevent the draining of the pump and outboard drive unit from creating a siphon effect that draws water from portions of the cooling system where heat producing components exists. The valve also allows intentional draining of the system when the vessel operator desires to accomplish this function. The valve incorporates a ball that is captivated within a cavity. If the ball is lighter than water, its buoyancy assists in the operation of the valve.

20 Claims, 3 Drawing Sheets

MARINE ENGINE COOLING SYSTEM WITH SIPHON INHIBITING DEVICE

BACKGROUND OF THE INVENTION

1. Field of the Invention

The present invention relates generally to a marine engine cooling system and, more particularly, to a cooling system that is provided with a siphon inhibiting device to alleviate problems in marine engine cooling systems that can possibly result due to heated water reversing its normal flow direction when the engine is off.

2. Description of the Prior Art

Those skilled in the art of marine propulsion systems are aware of many different types of engine cooling systems. Typically, a water pump is used to draw water from the body of water in which the marine propulsion system is operated. The water is then conducted through a series of passages and into thermal communication with various heat producing components, such as the engine and its exhaust manifolds. After being used to remove heat from the heat producing components, the water is then typically combined with an exhaust stream from the engine and conducted overboard back into the body of water from which it was drawn.

U.S. Pat. No. 5,980,342, which issued to Logan et al on Nov. 9, 1999, discloses a flushing system for a marine propulsion engine. The flushing system provides a pair of check valves that are used in combination with each other. One of the check valves is attached to a hose located between the circulating pump and the thermostat housing of the engine. The other check valve is attached to a hose through which fresh water is provided. Both check valves prevent flow of water through them unless they are associated together in locking attachment. The check valve attached to the circulating pump hose of the engine directs a stream of water from the hose toward the circulating pump so that water can then flow through the circulating pump, the engine pump, the heads, the intake manifold, and the exhaust system of the engine to remove seawater residue from the internal passages and surfaces of the engine. It is not required that the engine be operated during the flushing operation.

U.S. Pat. No. 5,334,063, which issued to Inoue et al on Aug. 2, 1994, describes a cooling system for a marine propulsion engine. A number of embodiments of cooling systems for marine propulsion units are disclosed which have water cooled internal combustion engines in which the cooling jacket of the engine is at least partially positioned below the level of the water in which the water craft is operating. The described embodiments all permit draining of the engine cooling jacket when it is not being run. In some embodiments, the drain valve also controls the communication of the coolant from the body of water in which the water is operating with the engine cooling jacket. Various types of pumping arrangements are disclosed for pumping the bilge and automatic valve operation is also disclosed.

U.S. Pat. No. 6,004,175, which issued to McCoy on Dec. 21, 1999, discloses a flush valve which uses only one moving component. A ball is used to seal either a first or second inlet when the other inlet is used to cause water to flow through the valve. The valve allows fresh water to be introduced into a second inlet in order to remove residual and debris from the cooling system of the marine propulsion engine. When fresh water is introduced into a second inlet, the ball seals the first inlet and causes the fresh water to flow through the engine cooling system. When in normal use, water flows through the first inlet and seals the second inlet by causing the ball to move against a ball seat at the second inlet. Optionally, a stationary sealing device can be provided within the second inlet and a bypass channel can be provided to allow water to flow past the ball when the ball is moved against the ball seat at the first inlet. This minimal flow of water is provided to allow lubrication for the seawater pump impeller if the seawater pump is operated during the flushing operation in contradiction to recommended procedure.

U.S. Pat. No. 6,135,064, which issued to Logan et al on Oct. 24, 2000, discloses an improved drain system. The engine cooling system is provided with a manifold that is located below the lowest point of the cooling system of the engine. The manifold is connected to the cooling system of the engine, a water pump, a circulation pump, the exhaust manifolds of the engine, and a drain conduit through which all of the water can be drained from the engine.

The patents described above are hereby expressly incorporated by reference in the description of the present invention.

In certain types of marine propulsion systems, water can drain and thereby create a siphon effect that draws water from other components of the cooling system. When the engine is turned off, cooling water in the outboard drive drains downward to the water line. This draining initiates a siphon effect which, in turn, draws cooling water from the heated engine in a backwards direction through the cooling circuit. The heated water from the engine then enters and remains in the fuel/water heat exchanger which, in most cases, is a coaxial heat exchanging device. The heated water in this fuel/water heat exchanger causes the liquid fuel to increase in temperature and, in certain cases, vaporize. When the operator of a marine vessel then tries to restart the engine, this partially vaporized fuel in the fuel/water heat exchanger is difficult to displace with the typical electric fuel pump that is normally used. As a result, vapor lock can be experienced.

It would therefore be significantly beneficial if a means could be provided that prevents the siphon effect from draining the water from the cooling system soon after the pump is deactivated. It would be further beneficial if the siphon inhibiting means could also allow later draining of the cooling system.

SUMMARY OF THE INVENTION

A marine cooling system made in accordance with the present invention comprises a pump, a heat producing component, and a conduit connected between the pump and the heat producing component. In a marine propulsion system, the heat producing component can be the engine itself or associated devices, such as the exhaust manifolds and the exhaust elbows.

A preferred embodiment of the present invention also comprises a valve connected in fluid communication with the conduit between the pump and the heat producing component. A ball or poppet is disposed within a cavity of the valve, with the valve having a first port and a second port. In certain embodiments of the present invention, a poppet valve can be used instead of the ball. Throughout the description of the present invention it should be understood that the use of the term "ball" should be understood to describe the use of either a ball or a poppet valve. The first and second ports of the valve allow water to flow into and out of the valve during operation of the engine and during draining. The valve is configured to receive a stream of water into the first port from the pump and then pass the stream of water serially through the cavity and the second port to the heat producing component. The present invention further comprises a seal which is responsive to movement of the ball within the cavity and located between the first port and the cavity in order to inhibit water flow through the cavity toward the pump. The valve is positioned to dispose the first port above the second port when associated within a cooling system of a marine engine.

In a particularly preferred embodiment of the present invention, the ball is less dense than water and, as a result, floats on the water which is within the cavity of the valve. The seal is responsive to an upward movement of the ball within the cavity and, in a particularly preferred embodiment of the present invention, the seal is a ball seat which is shaped to receive the ball in sealing contact in response to movement of the ball against the ball seat. When water exists within the cavity of the valve, the water causes the ball to rise because the ball is less dense than the water. As the ball rises, it moves into contact with the ball seat and provides a seal. Also, flow of water upward within the cavity toward the first port from the second port, will also cause movement of the ball in an upward direct toward the ball seat.

In one embodiment of the present invention, the valve comprises a first portion and a second portion that are attached together to define the cavity which captivates the ball. In certain embodiments of the present invention, a ball rest is formed in the cavity proximate the second port in order to support the ball. The ball rest permits water to flow around the ball and through the second port when the ball is located on the ball rest at the bottom of the cavity.

The cooling system of the present invention can further comprise an engine having a plurality of cooling passages, with the valve being connected in fluid communication between the pump and the cooling passages. It can also comprise a thermostat housing connected in thermal communication with the valve and with the pump. Similarly, a fuel cooler and an exhaust manifold can be incorporated as part of the cooling system, with the valve being connected in fluid communication between the pump and both the fuel cooler and the exhaust manifold.

Although not a requirement in all embodiments of the present invention, it is preferable to locate the valve in the cooling system conduit between the pump and other components of the cooling system. Since the purpose of the valve of the present invention is to prevent, or at least inhibit, siphoning of water back through the pump, locating the valve closer to the pump than the heat producing components will facilitate its operation.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
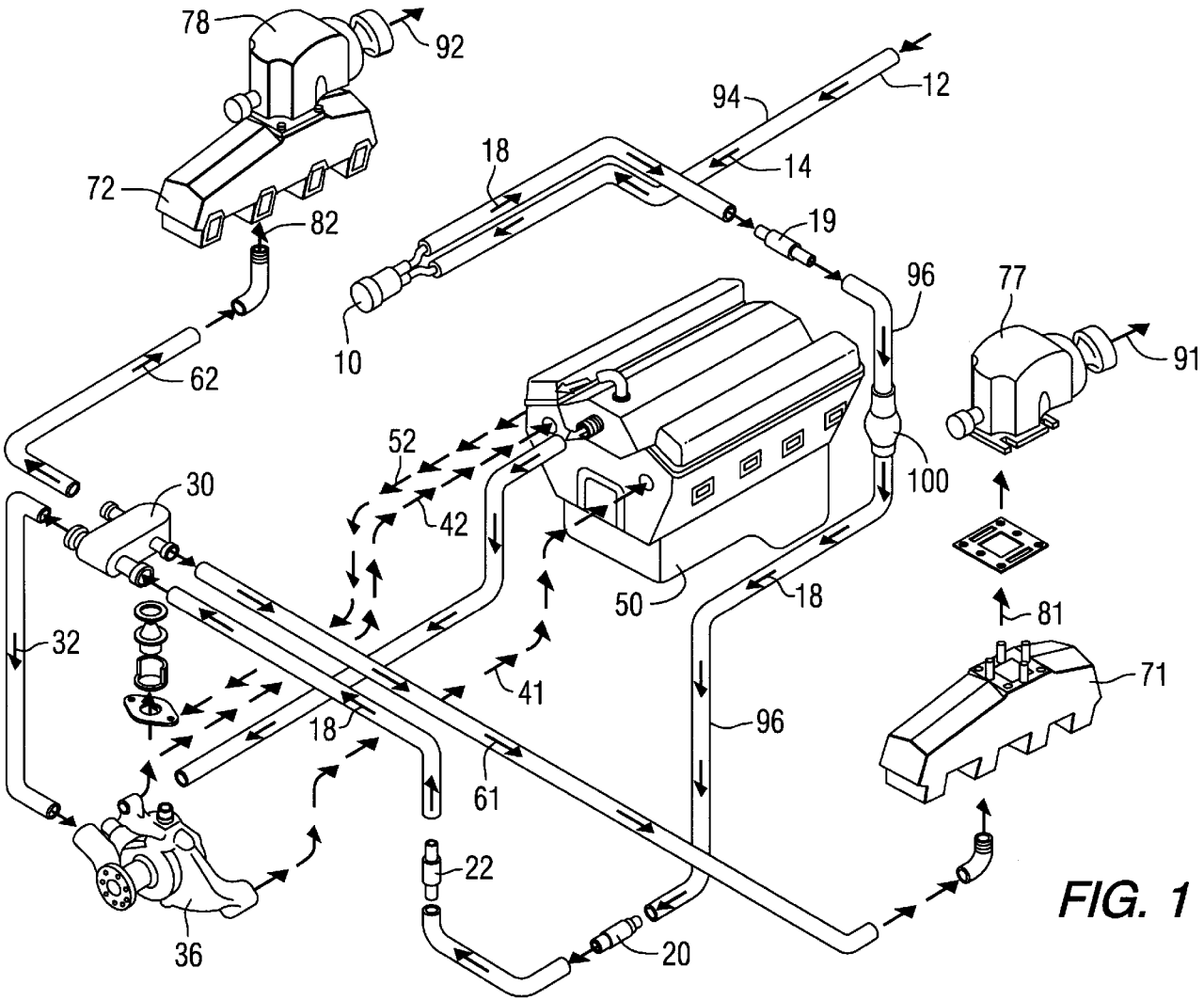
FIG. 1 is an exploded view of a marine engine cooling system.

Throughout the description of the preferred embodiment of the present invention, like components will be identified by like reference numerals.

FIG. 1 is an exploded view showing the components of a marine engine cooling system. In the exploded view, various water paths are represented by various series of aligned arrows. These individual flow paths will be identified by specific reference numerals in the following description.

A pump 10 draws water from an intake 12 along a flow path 14. The water intake 12 is disposed below the surface of a body of water in which the marine propulsion system is operating. Whether the body of water is a lake or sea, the water is drawn along flow path 14 by the pump 10 and induced to flow under pressure along flow path 18 and into the cooling passages of the cooling system. As an example, the power steering cooler 19, the fuel cooler 20, and an engine oil cooler 22 are shown connected in fluid communication with the conduits that conduct the flow path 18 toward a thermostat housing and cover assembly 30. From the thermostat housing 30, the cooling water is conducted along flow path 32 to an engine water circulating pump 36. From the engine water circulating pump 36, water is directed along two generally parallel flow paths, 41 and 42, into the engine 50 after passing through the cooling passages within the structure of the engine 50, the cooling water flows, along flow path 52, back to an inlet of the thermostat housing 30. From the thermostat housing 30, water flows in two parallel flow paths, 61 and 62, to the water jackets of the exhaust manifolds, 71 and 72. After passing through the water jackets of the manifolds, 71 and 72, the cooling water then flows into the exhaust elbows, 77 and 78, along flow paths 81 and 82. From there, the water is ejected with the exhaust gases as represented by flow paths 91 and 92.

When the engine 50 is turned off and the pump 10 becomes inactive, water can drain from the pump 10, in conduit 94, in a direction opposite to flow path 14. As this water in conduit 94 drains back into the body of water from which it was originally drawn, it can create a siphon effect which draws water from conduit 96 in a direction opposite to flow path 18. As a result of this siphon effect, water can be drawn from various portions of the cooling system and away from certain heat producing components, such as the engine 50 and exhaust manifolds, 71 and 72. This prevents the water from remaining in its intended locations to remove additional heat from the heat producing components. As described above in greater detail, the siphon effect can draw heated water back into the fuel/water heat exchanger and result in vaporization of the fuel in the heat exchanger. It should be understood that after the engine 50 is turned off, heat continues to emanate from the engine and be conducted into other various other components, particularly fuel containing and conducting components. As a result, these components experience a significant temperature rise after the engine is turned off. This temperature rise can create vapor lock problems when the operator of the marine vessel attempts to restart the engine. These vapor lock problems can be prevented if the cooling water remains within the cooling system in thermal communication with the heat producing components.

A siphon inhibiting device 100 is provided in series between the pump 10 and the heat producing components. The purpose of the siphon inhibiting device 100 is to prevent the flow of water within conduit 96, in a direction opposite flow path 18, resulting from a siphon effect that is initiated by water draining from the pump 10 back into the body of water in a direction opposite to the flow path 14.

Figure 2:
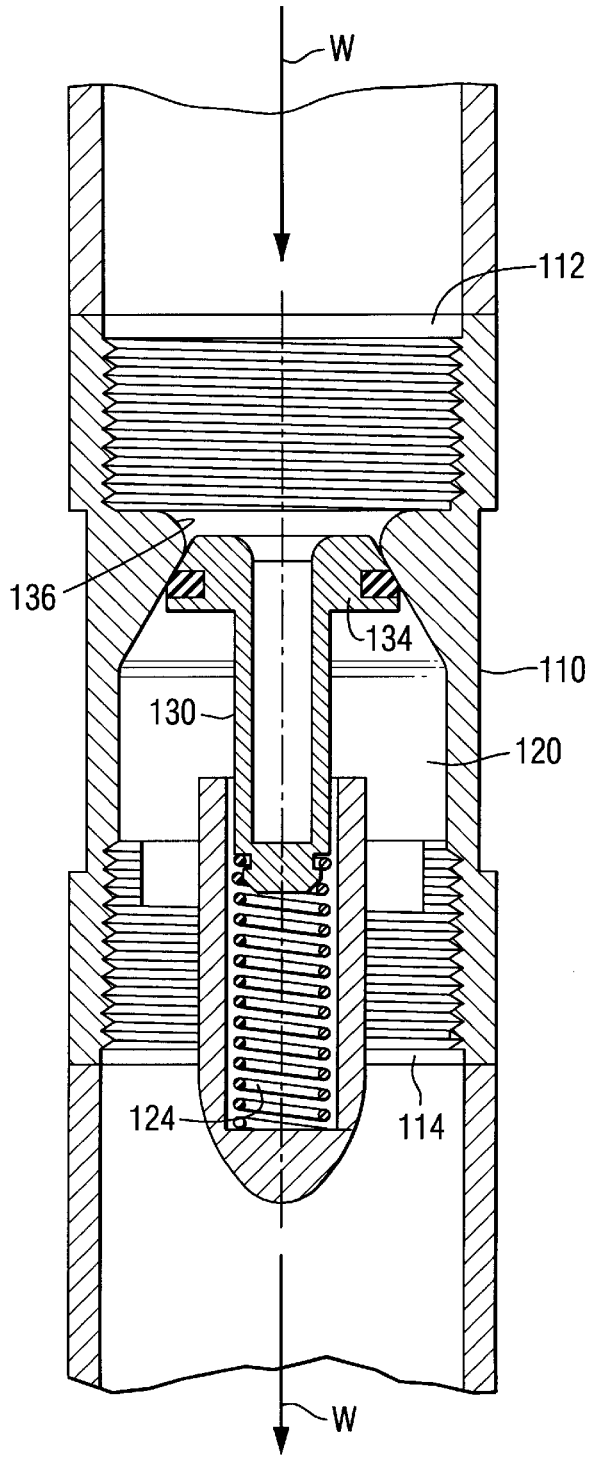
FIG. 2 PRIOR ART
FIG. 2 illustrates a prior art siphon inhibiting valve.

FIG. 2 shows a siphon inhibiting valve that is known to those skilled in the art and available in commercial quantities. The valve body 110 is provided with an inlet port 112 and an outlet port 114. When the pump 10 is operating, water flows in the direction represented by arrow W in FIG. 2, enters the inlet port 112, flows through the internal chamber 120 of the valve body 110, and exits from the valve through the outlet port 114. A spring 124 provides a force against a plunger 130 which seals a passage when the head 134 of the plunger 130 moves into sealing relation within a narrowed section 136 of the passage. Water pressure from the pump 10, causes the flow W against the head 134 of the plunger 130 and, as a result, provides sufficient force against the plunger 130 to compress the spring 124 and allow water to flow downward in FIG. 2 serially through the inlet port 112, the internal cavity 120, and the outlet port 114. When the pump 10 is deactivated as a result of the engine 50 being turned off, spring 124 moves the plunger 130 upward to prevent reverse flow in an upward direction in FIG. 2, opposite to the direction represented by arrows W. This prevents water from being drawn through conduit 96 in a direction opposite to the flow path 18 illustrated in FIG. 1. Several disadvantages are inherent in the design shown in FIG. 2. First, the force provided by spring 124 must be overcome by a downward force in the direction of arrow W against the head portion 134 of plunger 130. This results in a pressure drop through the valve which, in turn, causes a measurable loss of flow through the cooling system compared to the flow that could otherwise by pumped by the pump 10. Another deleterious result of the design shown in FIG. 2 is that water will be trapped on the inlet side of the head portion 134 when the operator wishes to drain the cooling system. Therefore, water will remain in certain conduits on the inlet side of the valve, upstream from the head portion 134 of plunger 130. As a result, the draining procedure will be incomplete and some water will remain in the cooling system. This incomplete draining procedure can result in significant damage in the event that ambient temperatures decrease to below the freezing point of the cooling water. In addition, if the operator of the marine vessel attempts to operate the engine while a blockage exists within the cooling system, such as frozen cooling water, this blockage will prevent appropriate cooling of the engine and may cause damage.

With continued reference to FIGS. 1 and 2, it will be significantly beneficial if a siphon inhibiting valve 100 could be provided without the inherent disadvantages of the valve shown in FIG. 2.

Figures 3, 4, 5:
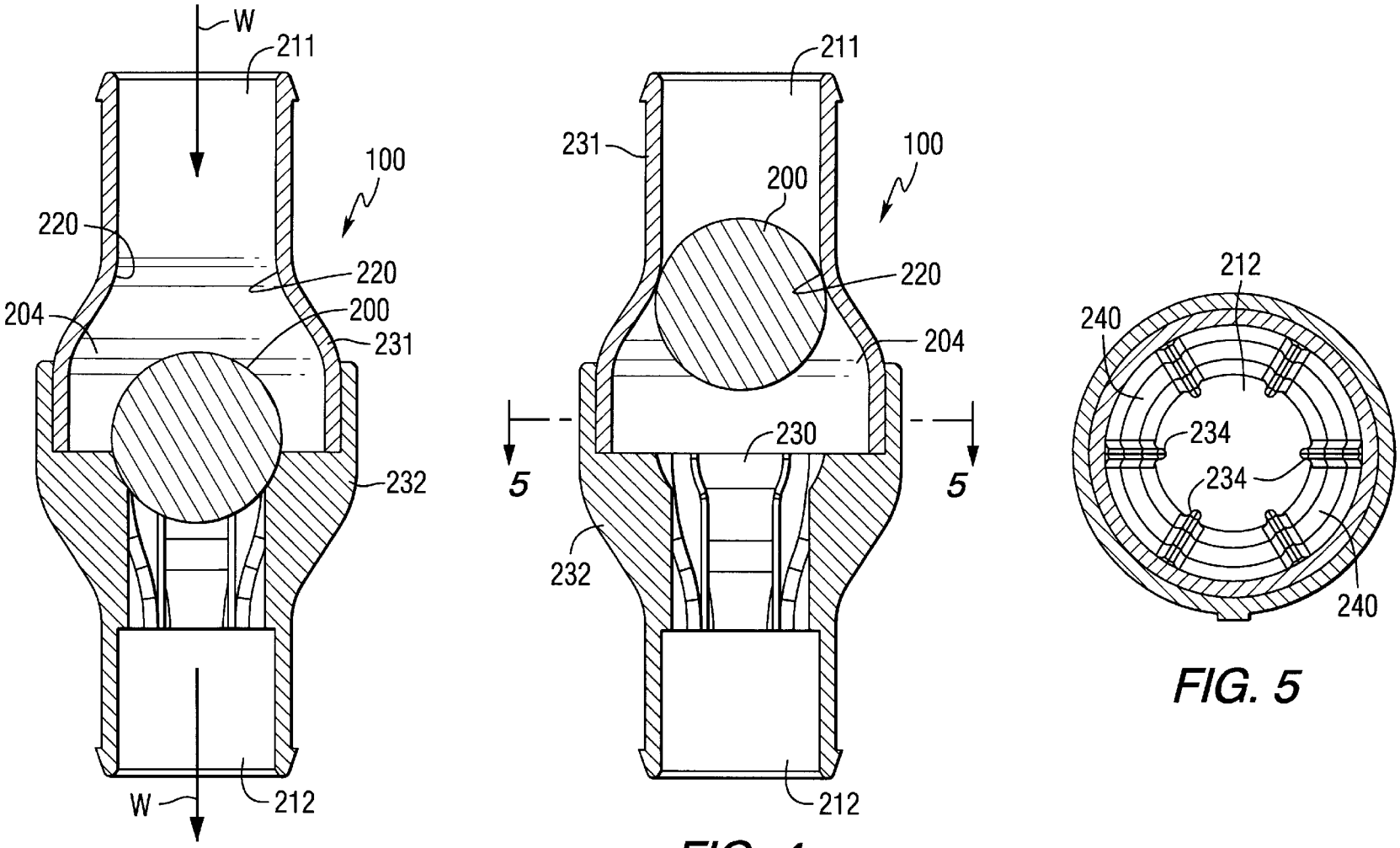
FIG. 3 and 4 show section views of the present invention under two states of operation.
FIG. 5 is a section view of FIG. 4.

FIG. 3 shows a section view of a siphon inhibiting valve 100 made in accordance with the principles of the present invention. The valve 100, as described above in conjunction with FIG. 1, is intended to be connected in fluid communication with a conduit 96 that is, in turn, connected between the pump 10 and a heat producing component, such as the engine 50 or the exhaust manifolds, 71 and 72. A ball 200 is disposed within a cavity 204 of the valve 100. The valve has a first port 211 and a second port 212. The valve is configured to receive a stream of water into the first port 211 from the pump 10, as described above in conjunction with FIG. 1, and past the stream of water serially through the cavity 204 and the second port 212 on its way to a heat producing component, such as the engine 50 or exhaust manifolds, 71 and 72. A seal, such as the ball seat 220 is responsive to movement of the ball 200 within the cavity 204. The seal is located between the first port 211 and the cavity 204 for the purpose of inhibiting water flow through the cavity 204 and through the first port 211 on its way back to the pump 10. In operation, the valve 100 is positioned in the cooling system to dispose the first port 211 above the second port 212.

In a particularly preferred embodiment of the present invention, the ball 200 is less dense than water and the seal, which comprises the ball seat 220, is responsive to the upward movement of the ball 200 within the cavity 204. In other words, when the ball 200 moves into contact with the ball seat 220, it blocks passage through the valve 100.

The valve 100 can comprise a first portion 231 and a second portion 232 which can be combined together, as shown in FIG. 3, to define the cavity 204 in which the ball 200 is captivated.

FIG. 3 shows the position of the ball 200, relative to the cavity 204 and relative to the second port 212, when water is flowing under the influence of the pump 10 in the direction represented by arrows W. When in this position, water can flow around the ball 200 with relatively little restriction. The resulting small pressure drop is not significant and does not represent an appreciable decrease in the efficiency of the cooling system.

FIG. 4 shows the valve 100 when the ball 200 is moved upward within the cavity 204 and against the ball seat 220. The ball 200 will assume this position under two different circumstances. First, if water attempts to flow upward through the valve 100, in the direction from the second port 212 towards the first port 211, the flow of water will carry the ball 200 upward and into contact with the ball seat 220. This will occur even if the ball is more dense than water. This movement will create a seal to prevent further movement of water in that same direction. Another circumstance that will cause the ball 200 to assume the position shown in FIG. 4 is the presence of non flowing water within the cavity 204. Since, in a preferred embodiment of the present invention, the ball 200 is less dense than water, it will float on the water within the cavity 204 and be moved into position against the ball seat 220. This position, as described above, will block further movement of water through the valve 100 in an upward direction from the second port 212 toward the first port 211.

With continued reference to FIG. 4, it should be noted that a ball rest 230 is formed in the cavity 204 proximate the second port 212 for the purpose of supporting the ball 200 when the ball moves to the position illustrated in FIG. 3. The ball rest 230 provides a plurality of ribs 234 as illustrated in FIG. 5 which is a section view of FIG. 4, as shown. The ribs 234 support the ball 200 above the non-ribbed portion of the surface 240 surrounding the opening leading to the second port 212. As a result, water can freely flow around the ball 200, and between the ribs 234, when water is flowing in the direction represented by arrows W in FIG. 3.

With reference to FIGS. 1, 3, 4, and 5, it can be seen that the present invention provides a means for preventing a siphon effect from drawing water through conduit 96 in a direction opposite to flow path 18. As described above, this siphon effect can be created when water drains from the conduit 94 in a direction opposite to the flow path 14. The valve 100 of the present invention prevents this continuing siphon effect that can lead to significant difficulty in starting the engine 50 because of vapor lock, as described in detail above. It can also be seen that the valve 100 of the present invention performs this function in a way that does not preclude the easy draining of the water cooling system at a later time. When the operator intentionally opens drain valves to induce draining of the cooling system, water flows away from the second port 212 and out of the cavity 204. As a result, support for the ball 200 is removed and, in addition, forces on the ball 200 in a downward direction exceeds those in a upward direction. As a result, the ball 200 falls away from the ball seat 220 and rests on the ball rest which comprises the ribs 234. This allows a complete draining of the system, including the portion of the cooling system comprising conduit 96 and the power steering cooler 19, if provided in this system. As a result, the valve 100 of the present invention provides the beneficial affect of preventing the siphoning of water out of the cooling system while not adversely affecting the easy draining of the system when the watercraft operator desires to do so.

Although the present invention has been described in considerable detail and illustrated to show a preferred embodiment, it should be understood that alternative embodiments are also within its scope.

I claim:

1. A marine engine cooling system, comprising:

a pump;

a heat producing component;

a conduit connected between said pump and said heat producing component;

a valve connected in fluid communication with said conduit between said pump and said heat producing component;

a ball disposed within a cavity of said valve, said valve having a first port and a second port, said valve being configured to receive a stream of water into said first port from said pump and pass said stream of water serially through said cavity and said second port to said heat producing component; and a seal, responsive to movement of said ball within said cavity, between said first port and said cavity to inhibit water flow through said cavity toward said pump, said valve being positioned to dispose said first port above said second port.

2. The cooling system of claim 1, wherein:

said ball is less dense than water.

3. The cooling system of claim 1, wherein:

said seal is responsive to an upward movement of said ball within said cavity.

4. The cooling system of claim 1, wherein:

said seal is a ball seat which is shaped to receive said ball in sealing contact in response to movement of said ball against said ball seat.

5. The cooling system of claim 1, wherein:

said valve comprises a first portion and a second portion, said first and second portions being combined to define said cavity.

6. The cooling system of claim 1, further comprising:

a ball rest formed in said cavity proximate said second port to support said ball, said ball rest permitting water to flow through said second port when said ball is at the bottom of said cavity.

7. The cooling system of claim 1, further comprising:

an engine having a plurality of cooling passages, said valve being connected in fluid communication between said pump and said cooling passages.

8. The cooling system of claim 1, further comprising:

a thermostat housing, said valve being connected in fluid communication between said pump and said thermostat housing.

9. The cooling system of claim 1, further comprising:

a fuel cooler, said valve being connected in fluid communication between said pump and said fuel cooler.

10. The cooling system of claim 1, further comprising:

an exhaust manifold, said valve being connected in fluid communication between said pump and said exhaust manifold.

11. A marine engine cooling system, comprising:

a pump;

a heat producing component;

a conduit connected between said pump and said heat producing component;

a valve connected in fluid communication with said conduit between said pump and said heat producing component;

a ball disposed within a cavity of said valve, said ball being less dense than water, said valve having a first port and a second port, said valve being configured to receive a stream of water into said first port from said pump and pass said stream of water serially through said cavity and said second port to said heat producing component; and a seal, responsive to an upward movement of said ball within said cavity, between said first port and said cavity to inhibit water flow through said cavity toward said pump, said valve being positioned to dispose said first port above said second port.

12. The cooling system of claim 11, wherein:

said seal is a ball seat which is shaped to receive said ball in sealing contact in response to movement of said ball against said ball seat.

13. The cooling system of claim 12, wherein:

said valve comprises a first portion and a second portion, said first and second portions being combined to define said cavity.

14. The cooling system of claim 13, further comprising:

a ball rest formed in said cavity proximate said second port to support said ball, said ball rest permitting water to flow through said second port when said ball is at the bottom of said cavity.

15. The cooling system of claim 14, further comprising:

an engine having a plurality of cooling passages, said valve being connected in fluid communication between said pump and said cooling passages.

16. The cooling system of claim 15, further comprising:

a thermostat housing, said valve being connected in fluid communication between said pump and said thermostat housing.

17. The cooling system of claim 16, further comprising:

a fuel cooler, said valve being connected in fluid communication between said pump and said fuel cooler.

18. The cooling system of claim 17, further comprising:

an exhaust manifold, said valve being connected in fluid communication between said pump and said exhaust manifold.

19. A marine engine cooling system, comprising:

a pump;

a heat producing component;

a conduit connected between said pump and said heat producing component;

a valve connected in fluid communication with said conduit between said pump and said heat producing component;

a ball disposed within a cavity of said valve, said ball being less dense than water, said valve having a first port and a second port, said valve being configured to receive a stream of water into said first port from said pump and pass said stream of water serially through said cavity and said second port to said heat producing component;

a seal, responsive to an upward movement of said ball within said cavity, between said first port and said cavity to inhibit water flow through said cavity toward said pump, said valve being positioned to dispose said first port above said second port, said seal being a ball seat which is shaped to receive said ball in sealing contact in response to movement of said ball against said ball seat; and an exhaust manifold, said valve being connected in fluid communication between said pump and said exhaust manifold.

20. The cooling system of claim 19, further comprising:

a ball rest formed in said cavity proximate said second port to support said ball, said ball rest permitting water to flow through said second port when said ball is at the bottom of said cavity;

an engine having a plurality of cooling passages, said valve being connected in fluid communication between said pump and said cooling passages;

a thermostat housing, said valve being connected in fluid communication between said pump and said thermostat housing; and a fuel cooler, said valve being connected in fluid communication between said pump and said fuel cooler, said valve comprising a first portion and a second portion, said first and second portions being combined to define said cavity.

* * * * *